United States Patent [19]

Strandli

[11] 3,992,996

[45] Nov. 23, 1976

[54] PROJECTILE WITH DELAYED BURSTING EFFECT

[75] Inventor: Kåre Roald Strandli, Raufoss, Norway

[73] Assignee: A/S Raufoss Ammunisjonsfabrikker, Raufoss, Norway

[22] Filed: May 17, 1974

[21] Appl. No.: 471,149

[30] Foreign Application Priority Data

May 18, 1973 Norway ..... 2067/73

[52] U.S. Cl. ..... 102/56 R; 102/60

[51] Int. Cl.[2] ..... F42B 13/12; F42B 13/14

[58] Field of Search ..... 102/52, 56, 66

[56] References Cited

UNITED STATES PATENTS

| | | | |
|---|---|---|---|
| 2,096,698 | 10/1937 | Lowy et al. | 102/66 X |
| 3,677,181 | 7/1972 | Giljarhus | 102/66 |

*Primary Examiner*—Verlin R. Pendegrass

*Attorney, Agent, or Firm*—Larson, Taylor and Hinds

[57] ABSTRACT

A projectile having at least one incendiary charge adapted to ignite on impact and burn through to a bursting charge rearwardly thereof includes an elongated opening in the incendiary charge for increasing the intensity of burning thereof.

4 Claims, 1 Drawing Figure

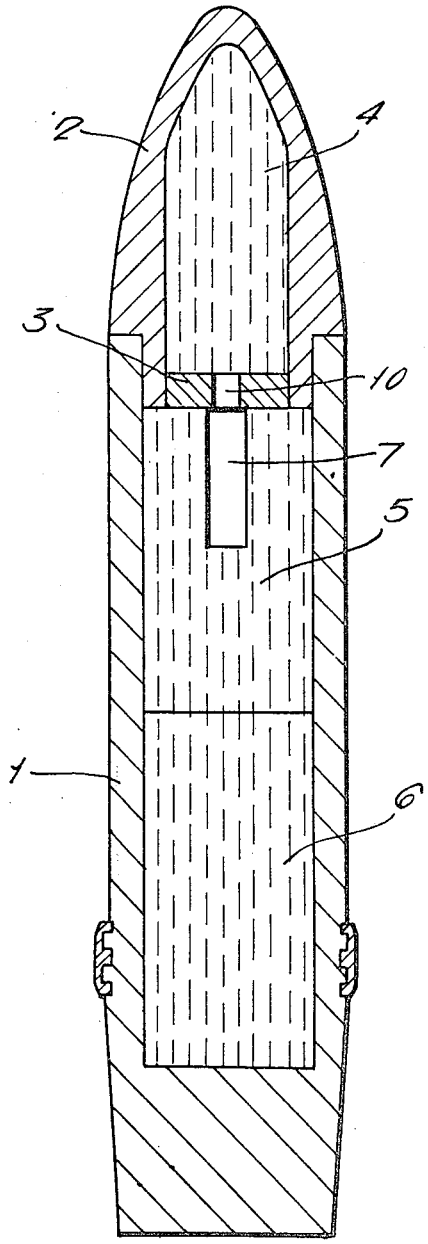
2
4
3
10
7
5
1
6

PROJECTILE WITH DELAYED BURSTING EFFECT

The present invention relates to a projectile having delayed bursting effect, i.e. a projectile containing at least one bursting charge which is ignited with a certain delay in relation to the impingement of the projectile against a target. A known principle to obtain such delay is to arrange at least one incendiary charge before the bursting charge in the projectile and to utilize the relatively low rate of combustion of the burning mass to obtain delayed bursting, said incendiary charge or charges being ignited at or immediately after the impingement against the target, either by means of an incendiary charge in the nose of the projectile or by the use of a fuse, resp. in combination with one or more safety devices.

The present invention concerns especially the problem of obtaining desired delay of the pyrotechnical chain at the reaction of one or more incendiary charges which are arranged before at least one bursting charge.

A near at hand method to objtain such desired delay is to adapt the composition, the compression and the dimensions of incendiary charge(-s) so that the desireable delay is obtained.

By adjusting the composition and compression of the incendiary mass the rate of combustion can be adjusted, and by adapting the length of the charge(-s) the time of burning-through at a certain rate of combustion can be adjusted. This way of adjusting the delay especially has the disadvantage that the incendiary charge(-s) located before the bursting charge in many cases will have to be made smaller than desireable to obtain a sufficiently short delay. Thereby the projectile will have reduced incendiary effect, which obviously often is undesired.

The above mentioned drawbacks are eliminated according to the invention.

A hole is provided in the incendiary charge and so adapted that the delay will be as desired. The precise size of the hole can be determined empirically.

In addition to the fact that the hole in itself reduces the length of the incendiary charge, which will have to be burned through before the bursting charge can be ignited, said hole results in that the rate of reaction in the burning mass is increased because the mass is ignited over a relatively large surface, namely the walls of the hole. This enhances the intensity of the combustion and makes increased safety for the ignition of the bursting charge. Thereby it is also possible to use a less sensitive bursting charge, whereby the handling safety for the projectile is increased.

The invention shall now be described with reference to an embodiment shown in the drawing.

The projectile consists of a main body 1, usually of steel, and a nose 2. This nose can contain an incendiary charge 4 intended for ignition by impingement of the projectile against the target. The incendiary charge 4 in the nose 2 is supported by a disc 3 having throughgoing hole 10. Behind the disc 3 is arranged an incendiary charge 5 and therebehind at least one bursting charge 6. In the incendiary charge 5 is at least one hole 7. The depth of the hole must be so adapted that desired delay is obtained. There can be more than one hole, but usually this is not necessary. The diameter of the hole can be small in relation to the diameter of the charge. Thereby the reduction of the charge due to the hole will be small, which is important to obtain the desired effect of the projectile.

The hole has as mentioned the effect that the combustion of the incendiary charge will have increased intensity due to the relatively large surface over which the ignition takes part. This effect can if desired be increased by arranging more, preferably parallel, holes having relatively small cross section. Thereby the total area of the walls of the holes can be large without the volume of the holes constituting any substantial part of the available volume for the incendiary charge.

I claim:

1. An elongated projectile of the type wherein the bursting effect is delayed following impingement of the front of the projectile against a target, comprising:

a bursting charge of a relatively low sensitivity, an incendiary charge arranged in front of the bursting charge, said incendiary charge being capable of burning through in a predetermined time, upon impingement of the projectile against a target, until it ignites the bursting charge, and means defining at least one hole extending longitudinally into the incendiary charge from the forward end thereof for increasing the intensity of burning of the incendiary charge by increasing the total burning surface area above that which would exist for an incendiary charge of the same overall dimensions without said hole, so that the said predetermined time of burning through of the incendiary charge with a said hole is less than the burning through time for an incendiary charge with the same overall dimensions and same burning rate composition and compression but without a said hole, and wherein the bursting charge has a sensitivity selected for cooperation with the said length and burning rate composition and compression of the incendiary charge with a hole which is less than would be required for use with an incendiary charge which burned through to ignite the bursting charge in the same said predetermined time but did not include a said hole.

2. A projectile according to claim 1 including a plurality of parallel holes having a small cross-section in relationship to the overall cross-section of the incendiary charge.

3. A projectile according to claim 1, wherein the said hole stops short of the rear end of the incendiary charge.

4. A projectile according to claim 1, said incendiary charge comprising a first incendiary charge in the nose of the projectile and a second incendiary charge behind the first incendiary charge and including a disc between said first and second incendiary charges and provided with a longitudinally extending hole therethrough, and wherein the said means defining a hole in the incendiary charge includes at least one further hole provided in the said second incendiary charge starting immediately behind the said hole in the disc.

* * * * *